United States Patent [19]

Drolet et al.

[11] Patent Number: 4,684,130

[45] Date of Patent: Aug. 4, 1987

[54] ICE HOCKEY STICK

[75] Inventors: Denis Drolet, Sherbrooke; William Burchmore, Magog; Léo Drolet, Cookshire, all of Canada

[73] Assignee: Inclasco Corporation Ltd., Canada

[21] Appl. No.: 467,850

[22] Filed: Feb. 18, 1983

[30] Foreign Application Priority Data

Dec. 23, 1982 [CA] Canada ..... 418423

[51] Int. Cl.[4] ..... A63B 59/14

[52] U.S. Cl. ..... 273/67 A; 273/DIG. 4; 273/DIG. 12; 273/DIG. 8; 273/DIG.23; 273/DIG. 7

[58] Field of Search ..... 273/67 A, 73 J, 75, 273/82 R, 72 R, DIG. 8, 73 F, 67 R, 67 D, 67 DA, 67 DB, 67 DC, DIG. 7, DIG. 23, 326; 145/61 C, 61 M, 61 H; 16/DIG. 19

[56] References Cited

U.S. PATENT DOCUMENTS

| | | | |
|---|---|---|---|
| 2,023,728 | 12/1935 | Evernden | 273/67 A |
| 2,504,242 | 4/1950 | Yerger | 273/67 A |
| 2,569,395 | 9/1951 | Zupanick | 273/67 A |
| 3,677,542 | 7/1972 | Michaud | 273/67 A |
| 3,770,033 | 11/1973 | Gavillet | 273/DIG. 8 X |
| 3,810,620 | 5/1974 | Decker et al. | 273/73 J X |
| 4,013,288 | 3/1977 | Goverde | 273/67 A |
| 4,014,542 | 3/1977 | Tanikawa | 273/72 R |
| 4,052,499 | 10/1977 | Goupil et al. | 273/67 A |
| 4,159,114 | 6/1979 | Ardell et al. | 273/67 A |
| 4,353,549 | 10/1982 | Goupil et al. | 273/67 A |

FOREIGN PATENT DOCUMENTS

| | | | |
|---|---|---|---|
| 447077 | 3/1948 | Canada | 273/67 A |
| 459578 | 9/1949 | Canada | 273/67 A |
| 36022 | 7/1967 | Finland | 273/67 A |
| 272851 | 3/1970 | U.S.S.R. | 273/67 A |

*Primary Examiner*—Richard C. Pinkham
*Assistant Examiner*—Matthew L. Schneider
*Attorney, Agent, or Firm*—Larson & Taylor

[57] ABSTRACT

An improved ice hockey stick is disclosed which is made with a handle component whose lower end tapers to fit closely into a closely conforming groove in the rear edge of a hardwood table. The handle component may be made of hardwood or it may be made of foam injected plastic material in accordance with another aspect of the subject matter disclosed. The foam injected handle component has a centrally located filler member and, on each side, a reinforcing strip of unidirectional strands of fibers in a suitable bonding agent mounted flush with the wide sides of the handle. A process for making a foam injected plastic component is disclosed as well as a method of making an ice hockey stick using the novel joint applicable to conventional hardwood handle components and to foam injected plastic handle components.

15 Claims, 4 Drawing Figures

ICE HOCKEY STICK

BACKGROUND OF THE INVENTION

This invention relates to improved ice hockey sticks such as used for playing the well-known game of ice hockey.

Ice hockey sticks are normally made of hardwood and comprise an elongated handle of rectangular cross-section and a blade permanently secured at a given obtuse angle to the lower end of the handle by means of a suitable glued joint and of a wrapping of glass fiber in an epoxy resin. The cost of hardwood handles and of reinforced hardwood handles becomes increasingly high on account of the limited supply of high quality hardwood suitable for this application and on account of the cost of labour and or raw material required for making wood laminates suitable as handle components, and the cost increases further when use is made of longitudinally extending reinforcing means such as reinforcing strips to strengthen the handle of the finished product.

Various attempts have been made in the past in order to produce handles for ice hockey sticks which do not require the use of expensive wood, but hiterto these attempts failed to produce commercially successful products at competitive prices.

SUMMARY OF THE INVENTION

The primary object of the present invention is to produce a handle for an ice hockey stick of professional caliber which is commercially feasible and which may be mass produced at relatively low cost as compared to the cost of the handle components used for producing commercially acceptable hockey sticks.

In accordance with this invention, an ice hockey stick handle component is provided which is made of foam injected plastic material of suitable density having a filler member centrally located in the handle component and a reinforcing strip of unidirectional strands of fibers in a suitable bonding agent embedded centrally on each side of the handle component. The preferred foam plastic materials are polyurethane, polyethylene and polypropylene.

The invention also provides a novel structure for joining a handle component and a blade component which is suitable for use in connection with a foam injected reinforced handle component, In accordance with this novel joint, the handle component terminates at its lower end with a gradual taper on each side thereof and a complementary groove is made in the rear edge of the hardwood blade for permanently receiving and retaining by glue the tapered portion of the handle component.

The invention also proposes to adapt the abovementioned novel joint to the making of ice hockey sticks using conventional hardwood handle components.

BRIEF DESCRIPTION OF THE DRAWINGS

A preferred embodiment of the present invention will now be described in detail with reference to the accompanying drawings wherein.

DESCRIPTION OF THE PREFERRED EMBODIMENTS

Figure 1:
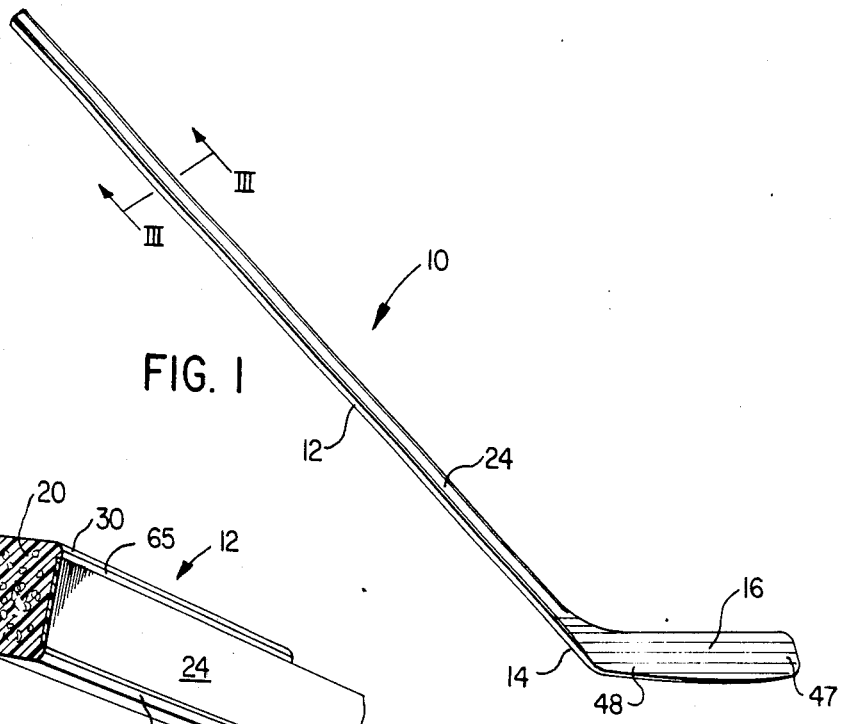
FIG. 1 is a perspective view of an ice hockey stick made in accordance with this invention.
Figure 2:
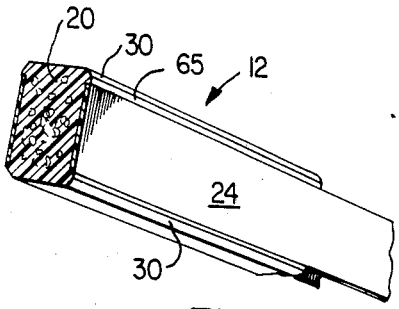
FIG. 2 is a partial perspective view of the upper end of a foam injected plastic handle component.

Referring now to the drawings, the ice hockey stick 10 shown in FIG. 1 is made of an elongated rigid handle 12 having a tapered lower end portion 14, and a blade 16 permanently secured to the tapered end 14 of handle 12. Handle component 12 is also visible in partial perspective view in FIG. 2 and in cross-sectional view in FIG. 3. It consists of an elongated body of foam injected plastic material 20 filled with a longitudinally extending filler member 22 and, centrally on each side of handle component 12, a flush reinforcing strip 24, 26 of unidirectional strands of fibers in a suitable bonding agent. In cross-section, handle 12 is essentially rectangular and constant throughout its length except at its lower tapered end portion 14 where the two sides (one of which is shown at 29) gradually taper inwardly as illustrated in FIG. 4. As in conventional ice hockey stick handle designs, handle 12 is chanfered on all four corners as shown at 30, which chanfers terminate at the start of the tapered end portion 14 as shown at 32 in FIG. 4.

The cross-section of filler 22 is not critical to this invention nor is the type of material used therefor. In a preferred embodiment, filler 22 is an I-shaped solid piece of softwood whose main purpose is to reduce the amount of foam plastic material required for the manufacture of handle 12. It also serves as a spacer during the manufacture of handle 12 as will be described below.

The presence of preformed reinforcing strips 24 and 26 ensures the required degree of longitudinal rigidity of handle 12, and the exact dimensions of reinforcing strips 24 and 26 as well as their compositions are basically a question of design to suit the needs of the players. Nevertheless, reinforcing strips 24 and 26 are preferably of constant rectangular cross-section and they are very thin as compared with the thickness of handle 12. They extend along the full length of the handle component and terminate just slightly inwardly of the corners 30. They also extend into the lower tapered end 14 and terminate at the thin bottom edge 36 which is at angle "x" with respect to the rear edge 38 of handle 12. Angle "x" determines the approximate angular relationship between blade 16 and handle 12, which angular relationship varies slightly among the various models of ice hockey sticks offered to hockey players to suit their particular requirements as in well-known in the art.

The foam injected plastic material may be any suitable foamable plastic such as polyurethane, polyethylene and polypropylene and the shape of tapered end 14 is obtained in the moulding operation by so constructing the cavity of the mold used for this purpose.

The process for making handle 12 uses the relatively well-known technique called rim molding which involves the use of a suitable mold (not shown) having any number of identical cavities whose shapes correspond to the desired shape of the finished handle component 12. The process involves placing in the bottom of the cavity of the mold a reinforcing strip 24, 26, placing filler 22 over the first strip, and placing a second reinforcing strip 24, 26 over filler 22 after which the mold is closed and the plastic material is injected. Heat is then applied in order to effect curing and foaming of the plastic material and then the mold is opened and the handle component 12 is removed. The sides 29 of the tapered end portion 14 may be abraded slightly by sanding in order to remove all impurities and provide some degree of rugosity for better adhesion of glue, and it is ready for the next operation.

Blade component 16 and handle 12 are then glued together using a strong glue such as epoxy resin or a suitable wood glue compatible with foam plastic and the material of which reinforcing strips 24 and 26 are made.

Blade component 16 is made of hardwood whose grain extends in the longitudinal direction as illustrated by arrow 40. A solid piece of hardwood may be used but it is preferred to use a series of strips of solid hardwood 41 to 46 extending longitudinally from end to end and glued together on their contiguous edges. It may taper in the longitudinal direction because the free end 47 of the finished product 10 may be considerably thinner than its region 48 adjacent the joint. The outline of the blade component 16 is generally rectangular except its rear edge 50 which is cut at an angle equal to angle "x" of the tapered end 14 of handle component 12. A groove 52 is cut into rear edge 50 at equal distance from the two wide side surfaces of blade component 16. Groove 52 conforms very closely to the shape of tapered end 14 of handle component 12. Groove 52 has a constant depth equal to the length of bottom edge 36 of handle component 12 and the inner walls of groove 52 are planar and strictly parallel to the mating surfaces of handle component 12. Therefore, the distance between the inner walls of groove 52 is constant when measured along a plane normal or at right angles to the longitudinal axis of handle component 12 of the axis along which the rear edge 50 extends. Rear edge 38 of handle component 12 becomes flush with rear edge 50 of blade component 16 when tapered end 14 is glued in place into groove 52. Likewise, thin bottom edge 36 of tapered end 14 of handle component 12 is flush with bottom edge 53 of blade component 16 when the two components 12 and 16 have been permanently glued together.

The next step in the method of manufacture of ice hockey stick 10 involves cutting blade component 16 to the desired outline 55 illustrated by a dotted line in FIG. 4 to produce the profile of the blade of the finished ice hockey stick 10. After that blade portion is further sanded to reduce it to the finished thickness, and then it may be heated so as to curve it transversally after which reinforcement is applied by wrapping or applying glass fiber cloth which will be held in place by means of a coating of epoxy resin or other adequate coating which bonds together the fibers of the reinforcing cloth as is well known in the art. The ice hockey stick 10 may then be printed with various grade and quality indications and ornamentation may be applied as is current in the trade.

Thus, the invention provides a methof of joining together a handle component and a blade component which may be adapted for using a molded foam plastic handle component reinforced with rigid strips of strong fibers, but the same joint is also applicable to handle components made of hardwood either in the form of a solid piece of hardwood such as ash and white birch or in the form of hardwood laminates, with or without reinforcing means such as reinforcing strips 24 and 26. In accordance with this novel joint, the blade is made of a piece of hardwood whose grain extends longitudinally of the blade from the tip theeof 47 to the front edge 59 of handle component 12 and over both sides 29 of tapered end 14. The resultant joint has proved to be surprisingly strong in spite of its simplicity and ease of manufacture, the only critical aspect of such a joint being the close conformity between tapered end 14 of handle component 12 and groove 52 of blade component 16.

The material used for making preformed reinforcing strips 24, 26 which are normally produced by pultrusion techniques comprise fibers of glass, fibers of graphite or fibers of aramide or any combination thereof, suitably held together by an appropriate bonding agent such as epoxy resin.

Figure 3:
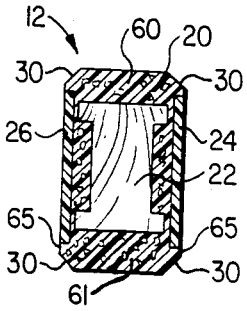
FIG. 3 is a cross-sectional view taken along line 3—3 of FIG. 1.
Figure 4:
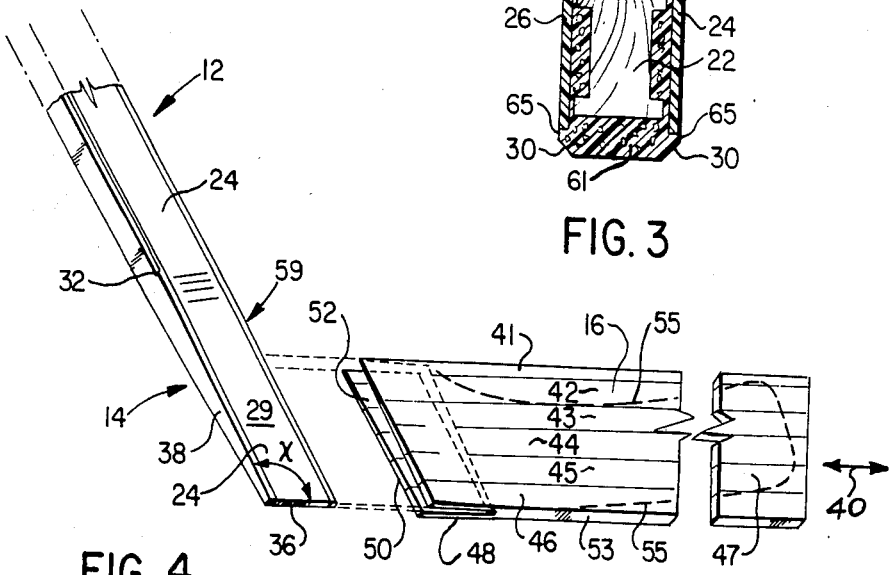
FIG. 4 is a perspective exploded view of a handle component showing a tapered end, and of a blade component showing a V-shaped groove in the rear edge thereof for receiving the tapered end of the handle component.

The cross-section of filler member 22 shown in FIG. 3 is I-shaped and this component is made of a solid piece of softwood on account of the fact that this material is cheap, light weight and easily available. Obviously other types of material could be used instead of softwood if such were available. Other configurations of filler can also be envisaged on account of the limited role played by this component and its only critical dimension is that which determines the distance between reinforcing strips 24 and 26 when placed in the cavity of the mold prior to injection of the plastic material in liquid form. The dimension in question which, in the illustrated I-shaped embodiment ofFIG. 3, is the length of the transverse upper and lower bars 60 and 61 of I-shaped filler 22 must be sufficient to maintain proper distance between reinforcing strips 24 and 26 throughout the molding operation of handle component 22 in order to avoid, as much as possible, the presence of foam plastic on the outside of reinforcing strips 24 and 26 except if it was desired to completely cover these surfaces in which case a uniform covering would be required and particular care should be taken when so constructing a handle component. In principle, however, it is preferable to avoid the presence of such foam plastic over the surface of reinforcing strips 24 and 26 in order to produce a satisfactorily attractive finish product without the necessity of sanding the sides of the finished handle component. The outer surfaces of reinforcing strips 24 and 26 constitute a proper surface for applying decorative means and written inscriptions such as the name of the manufacturer or its trade mark and the model dsignation of each particular class of ice hockey stick. Thus, it is best to ensure that in the finished product the reinforcing strips 24 and 26 are flush with the adjacent plastic material inwardly of chanfers 30 as shown at reference numeral 65 in FIGS. 2 and 3.

It should be understood that the scope of the present invention is not intended to be limited to the specific preferred embodiment illustrated in the drawings and described above.

We claim:

1. A handle component for ice hockey sticks, said handle component having generally a rectangular cross-section and comprising a front and a rear side and two opposite lateral sides, said handle component further comprising:

a body of foam injected plastic material chosen from the group consisting of polyurethane, polyethylene and polypropylene;

a longitudinally extending, centrally located filler member constituted by a piece of softwood; and centrally on each lateral side, a flush reinforcing strip of undirectional strands of fibers in a bonding agent;

wherein one end of said handle component tapers inwardly on each lateral side thereof to a thin central edge cut at an obtuse angle with respect to the rear side of said handle component, said end being adapted to be inserted in a groove made in a blade component for forming a hockey stick; and wherein said filler is disposed between said reinforcing strips and extends along substantially the full length of said handle component but terminates short of said thin central edge, said filler having a constant I-shaped cross section at least inwardly of the tapered end of said handle component and being coaxial relative to said handle component with the central member thereof extending parallel to and equidistant from said reinforcing strips.

2. A handle component as defined in claim 1 wherein the distance between said two opposite lateral sides defines the thickness of said handle component, each reinforcing strip is of constant rectangular cross-section and is very thin as compared with the thickness of said handle component.

3. A handle component as defined in claim 2 wherein each reinforcing strip extends along the full length of said handle component and terminates just slightly inwardly of the corners edging the lateral sides.

4. A handle component as defined in claim 1 wherein said fibers are chosen in the group consisting of fibers of glass, fibers of graphite and fibers of aramid.

5. An ice hockey stick comprising:

an elongated rigid handle having a front and a rear side and two opposite lateral sides, said handle having a generally constant rectangular cross-section and also comprising a tapered lower end portion, said handle further comprises:

(a) a body of foam injected plastic material of a suitable density and resistance;

(b) a longitudinally extending, centrally located filler member; and (c) centrally on each lateral side, a flush reinforcing strip of undirectional strands of fibers in a suitable bonding agent;

a blade comprising a rear edge and being permanently secured to said lower end portion of said handle by means of a glued joint consisting of a conforming tapered groove in the rear edge of said blade into which the lower end portion of said handle is completely inserted having the rear side of the tapered lower end portion flush with the rear edge of said blade, said blade being made of a piece of hardwood whose grain extends longitudinally from end-to-end of said blade and extending over both lateral sides of said tapered lower end portion.

6. An ice hockey stick as defined in claim 5 wherein the distance between said two opposite lateral sides defines the thickness of said handle component, each reinforcing strip being of constant rectangular cross-section and is very thin as compared to the thickness of said handle.

7. An ice hockey stick as defined in claim 6 wherein each reinforcing strip extends along the full length of said handle and terminates just slightly inwardly of the corners edging the lateral sides.

8. An ice hockey stick as defined in claim 7 wherein the tapered end of said handle terminates as a thin central edge cut at an obtuse angle with respect to the rear side of said handle.

9. An ice hockey stick as defined in claim 5 wherein the foam injected plastic material is one of the substances in the class comprising polyurethane, polyethylene and polypropylene.

10. An ice hockey stick as defined in claim 5 wherein the foam injected plastic material is a substance chosen from the group consisting of the class comprising polyurethane, polyethylene and polypropylene, and wherein said filler is a piece of softwood disposed between said reinforcing strips and extending along substantially the full length of said handle.

11. An ice hockey stick as defined in claim 5 wherein one end of said handle tapers inwardly on each lateral side thereof to a thin central edge cut at an obtuse angle with respect to the rear side of said handle, wherein the foam injected plastic material is a substance chosen in the group consisting of polyurethane, polyethylene and polypropylene, and wherein said filler is a piece of soft wood disposed between said reinforcing strips and extending along substantially the full length of said handle but terminating short of said thin central edge, said filler having a constant I-shaped cross-section at least inwardly of the tapered end of said handle and being coaxial relative to said handle with the central member thereof extending parallel to and equidistant from said reinforcing strips.

12. An ice hockey stick as defined in claim 5 wherein said fibers are chosen in the group consisting of fibers of glass, fibers of graphite and fibers of aramid.

13. A blade component for an ice hockey stick, said blade component being made of hardwood and comprising:

two wide side surfaces generally parallel to the plane of said blade component;

a lower edge;

a rear edge comprising a tapered groove lying in the plane of sid blade component and being equidistant from said two wide side surfaces, said tapered groove comprising two inner walls which are substantially flat and facing each other, said tapered groove having a constant depth, said rear edge extending along an axis lying in the plane of said blade component and making an obtuse angle with said lower edge, said inner walls converging along said axis toward said lower edge, the distance between two inner walls when measured across an imaginary reference line lying in the plane of said blade component and perpendicular to said axis remaining constant along the imaginary reference line.

14. A blade component as defined in claim 13 wherein the bottom of said tapered groove is flat.

15. A blade component as defined in claim 13 wherein said blade is made of at least two or more longitudinally extending pieces of hardwood attached edgewise to one another.

* * * * *